US008605129B1

(12) United States Patent
Barson et al.

(10) Patent No.: US 8,605,129 B1
(45) Date of Patent: Dec. 10, 2013

(54) METHOD AND SYSTEM FOR PROVIDING TAMPER RESISTANT CHECKS

(75) Inventors: Karen Barson, San Mateo, CA (US); Kris R. Chopra, Santa Cruz, CA (US); Michael Tretola, Mountain View, CA (US); Margaret Tretola, legal representative, Concord, CA (US)

(73) Assignee: Intuit Inc., Mountain View, CA (US)

( * ) Notice: Subject to any disclaimer, the term of this patent is extended or adjusted under 35 U.S.C. 154(b) by 155 days.

(21) Appl. No.: 13/350,556

(22) Filed: Jan. 13, 2012
(Under 37 CFR 1.47)

(51) Int. Cl.
*B41J 2/435* (2006.01)

(52) U.S. Cl.
USPC ..... 347/224; 347/262; 347/264

(58) Field of Classification Search
USPC ..... 347/224, 262, 264
See application file for complete search history.

(56) References Cited

U.S. PATENT DOCUMENTS 4,637,634 A * 1/1987 Troy et al. ..... 705/14.17
5,190,318 A * 3/1993 Mantegazza ..... 283/82

* cited by examiner

*Primary Examiner* — Huan Tran
(74) *Attorney, Agent, or Firm* — McKay and Hodgson, LLP; Philip McKay; Sean P. Lewis

(57) ABSTRACT

A tamper resistant check includes a first region on a first surface of the tamper resistant check and a second region on the first surface of the tamper resistant check. The second region on the first surface of the tamper resistant check corresponds to at least one critical field associated with the tamper resistant check including, but not limited to, one or more of the payee field, the amount field, and/or the signature field. The second region on the first surface of the tamper resistant check is designed so that toner-based characters/symbols applied by a laser printer to the second region cannot be removed from the second region without leaving visible evidence of the tampering.

27 Claims, 4 Drawing Sheets

METHOD AND SYSTEM FOR PROVIDING TAMPER RESISTANT CHECKS

BACKGROUND

While electronic transactions, such as credit card and debit card transactions, have continued to rise in popularity, 75% of all commercial payments are still conducted using printed checks. In addition, the overwhelming majority of printed checks are now created/generated using one or more computing systems, computing system applications, and a laser printer.

A significant problem facing any entity using printed checks is a check fraud. Currently, check fraud takes several forms and accounts for over $20 billion of criminal activity per year with a current annual growth rate of 25% per year. As a result, one in four businesses is a victim of fraud with an average loss of $50,000, and 45% of these cases involve check fraud. Small businesses are particularly vulnerable to check fraud with an estimated 30% of small businesses failing due to fraud of one form or another.

One form of check fraud involves the actual counterfeiting of checks, i.e., a perpetrator creating a fraudulent physical check that is designed to mimic/copy checks provided by financial institutions, such as banks and credit card companies, and/or provided by various financial management systems, such as computing system implemented small business and personal financial management systems. In these cases, once the counterfeit check has been created, the perpetrator can then fill in critical fields of the check, such the payee and amount fields, as desired and forge, or otherwise fraudulently obtain, authorization signatures.

In an attempt to prevent check counterfeiting, the vast majority of checks provided to businesses and individuals currently include one form or another of anti-counterfeiting check features such as a printed, and/or colored, check designs, images, and/or patterns that typically cover the entire surface of the check, including the various check fields such as the amount and payee fields. While these anti-counterfeiting check features often do make it difficult to create counterfeit checks, the introduction of printed, and/or colored, check designs, images, and/or patterns that cover the entire surface of the check opens other opportunities for check fraud, such as check forgery.

Check forgery is the second largest form of crime committed against consumers/small businesses after identity theft. Check forgery is defined as adding, removing, or altering check information in order to perpetuate fraud; as opposed to counterfeiting which, as discussed above, involves copying an original check to perpetuate check fraud.

For instance, the inclusion of anti-counterfeiting check features such as printed, and/or colored, check designs, images, and/or patterns that cover the entire surface of the check make it easier for perpetrators of check fraud to commit check forgery by tampering with critical fields of already generated checks, such as the payee and/or amount fields, without leaving readily visible telltale traces of their work.

As noted above, the vast majority of checks used today, particularly those used by businesses, are laser printed checks whereby the various fields of the check, including the critical fields such as payee and/or amount fields, are filled in/populated with desired characters/symbols using laser printers. Laser printers have been widely adopted for decades and represent a significant technological advance over inkjet printers in terms of cost, practicality, speed, and efficiency. As a result, over 80% of all checks generated by printers are now generated by laser printers.

Unlike ink jet technology, laser printers do not use liquid ink that, in terms of countering fraud, advantageously soaks into the check substrate. Instead, laser printers utilize toner which is a form of powdered ink that is applied to the surface of the check and adhered to the check surface using heat to literally melt the toner onto the surface of the check, but typically not into the check substrate surface. As a result, depending on the quality of the laser printer and the adhesion properties of the check, it can be relatively easy to remove the toner, i.e. the printed characters/symbols, from the surface of currently available checks generated with a laser printer.

As one example, current perpetrators of fraud will often obtain a check generated with a laser printer and then exploit the fact that the laser printer toner resides only on the surface of the check to remove the toner-based characters/symbols using one of several methods. These methods for removing toner, i.e., the printed characters, from the surface of currently available laser printer generated checks include, but are not limited to: using tape, or another adhesive material, to literally lift the toner from the surface of the check in selected critical regions/fields, such as the payee or amount fields; using one or more edged devices, such as a razor, to scratch the toner from the surface of the check in selected critical regions/fields; using a chemical wash, or treated fabric, to wipe away the toner from the surface of the check in selected fields; and various other more or less sophisticated methods for removing the toner from the surface of the check in selected critical regions/fields.

Once a perpetrator of check fraud has removed the toner, i.e., the printed characters/symbols, from the surface of selected fields of the laser printer generated check, the perpetrator is then free to substitute whatever characters/symbols desired and thereby effectively make the check out to whomever they like and/or for whatever amount they desire.

To counter toner removal, some makers of checks now provide checks that include special adhesion coatings, and/or toners that are chemically designed to better adhere to the check surface. However, these approaches have typically provided limited results that, at best, only make it harder to remove the toner but still result in toner based characters/symbols that can be removed from the check surface by even a semi-skilled perpetrator of check fraud.

Fortunately, in the course of perpetrating the toner removal form of check fraud described above, it is extremely difficult to remove the laser printer applied toner from the surface of a laser printer generated check without leaving small traces of either the toner, or other evidence of the tampering, such as light smudging of toner on the surface of the check, small portions of toner that are not completely removed, and/or slight damage to the surface region of the check where the toner has been removed. However, as noted above, in order to prevent the counterfeiting and/or forgery of checks, the vast majority of checks include intricate anti-counterfeiting patterns, designs, images, and/or colored surfaces and while these measures do help prevent check counterfeiting and/or forgery they also serve to mask the small traces of toner, and/or other evidence of tampering, resulting from the removal and replacement of toner-based characters. In short, the same intricate patterns, designs, images, and/or colored surfaces that make the check difficult to counterfeit also serve to camouflage the small traces of toner, and/or other subtle evidence of tampering, that results from the removal and replacement of toner-based characters/symbols. Consequently, using current laser printer generated checks it is relatively easy to remove and replace toner characters without leaving traces of the tampering that are readily noticeable in the anti-counterfeiting patterns, designs, images, or colors on the surface of the check.

As a result of the situation discussed above, check fraud, and particularly check fraud involving toner character removal and replacement, is difficult to detect and contributes significantly to the billions of dollars misappropriated each year by perpetrators of check fraud. What is needed is a method and system from providing tamper resistant checks that are difficult to counterfeit yet readily reveal evidence of tampering.

SUMMARY

In accordance with one embodiment, a system and method for providing tamper resistant checks includes a process for providing tamper resistant checks whereby a tamper resistant check is created, and provided to a user, that in one embodiment, includes a first region on a first surface of the tamper resistant check that has one or more anti-counterfeiting check features such as, but not limited to, printed, and/or colored, check surface designs, images, and/or patterns, that cover at least part of the first region on the first surface of the tamper resistant check. In one embodiment, the tamper resistant check first surface also includes a second region, the second region on the first surface of the tamper resistant check being separate from the first region on the first surface of the tamper resistant check. In one embodiment, the second region on the first surface of the tamper resistant check has no anti-counterfeiting check features, e.g., is blank so that toner-based characters/symbols cannot be removed from these regions without leaving visible evidence. In another embodiment, the second region on the first surface of the tamper resistant check has check features different from the anti-counterfeiting check features of the first region on the first surface of the tamper resistant check that also prevent toner-based characters applied by a laser printer to the second region from being removed from the second region without leaving visible evidence. In one embodiment, the second region on the first surface of the tamper resistant check corresponds to at least one critical field associated with the tamper resistant check including, but not limited to, one or more of the payee field, the amount field, and/or the signature field.

Using one embodiment of the system and method for providing tamper resistant checks, as discussed herein, a tamper resistant check is provided wherein anti-counterfeiting check features such as, but not limited to, printed, and/or colored, check surface designs, images, and/or patterns, are provided on a first region of the first surface of the tamper resistant check so that the tamper resistant check is protected from attempts to counterfeit entire check. In addition, in one embodiment other regions of the tamper resistant check corresponding to critical fields such as, but not limited to, the payee field and/or the amount fields, are left blank, i.e., without any anti-counterfeiting check features, so that toner-based characters cannot be removed from these regions without leaving visible evidence of their removal. Consequently, the resulting tamper resistant check is largely invulnerable to both counterfeit-based and forgery-based check fraud and toner removal/replacement-based check fraud.

In accordance with one embodiment, a system and method for providing tamper resistant checks includes a process for providing tamper resistant checks whereby a tamper resistant check is created, and provided to a user, that, in one embodiment, includes a first region on a first surface of the tamper resistant check that is comprised of a first check substrate material. In one embodiment, the tamper resistant check first surface also includes a second region on the first surface of the tamper resistant check, separate from the first region on the first surface of the tamper resistant check. In one embodiment, the second region on the first surface of the tamper resistant check is comprised of a second check substrate material that is distinct from the first check substrate material and is relatively delicate and subject to damage in the event of tampering. In one embodiment, the second region on the first surface of the tamper resistant check corresponds to at least one critical field associated with the check including, but not limited to, one or more of the payee field, the amount field, and/or the signature field.

Using one embodiment of the system and method for providing tamper resistant checks, as discussed herein, a tamper resistant check is provided wherein a first region of the tamper resistant check is made of a first substrate material, such as relatively durable and/or thick paper, while a second region of the tamper resistant check corresponding to critical fields such as, but not limited to, the payee field and/or the amount field, are made of a second substrate material that is relatively thin, and/or fragile, so that any attempts to remove and/or replace toner from the second region will result in the visible tearing, and/or damaging, of the second substrate material. Consequently, the resulting tamper resistant check is largely invulnerable to toner removal/replacement-based check fraud while still providing a relatively durable and practical tamper resistant check.

Figure 1:
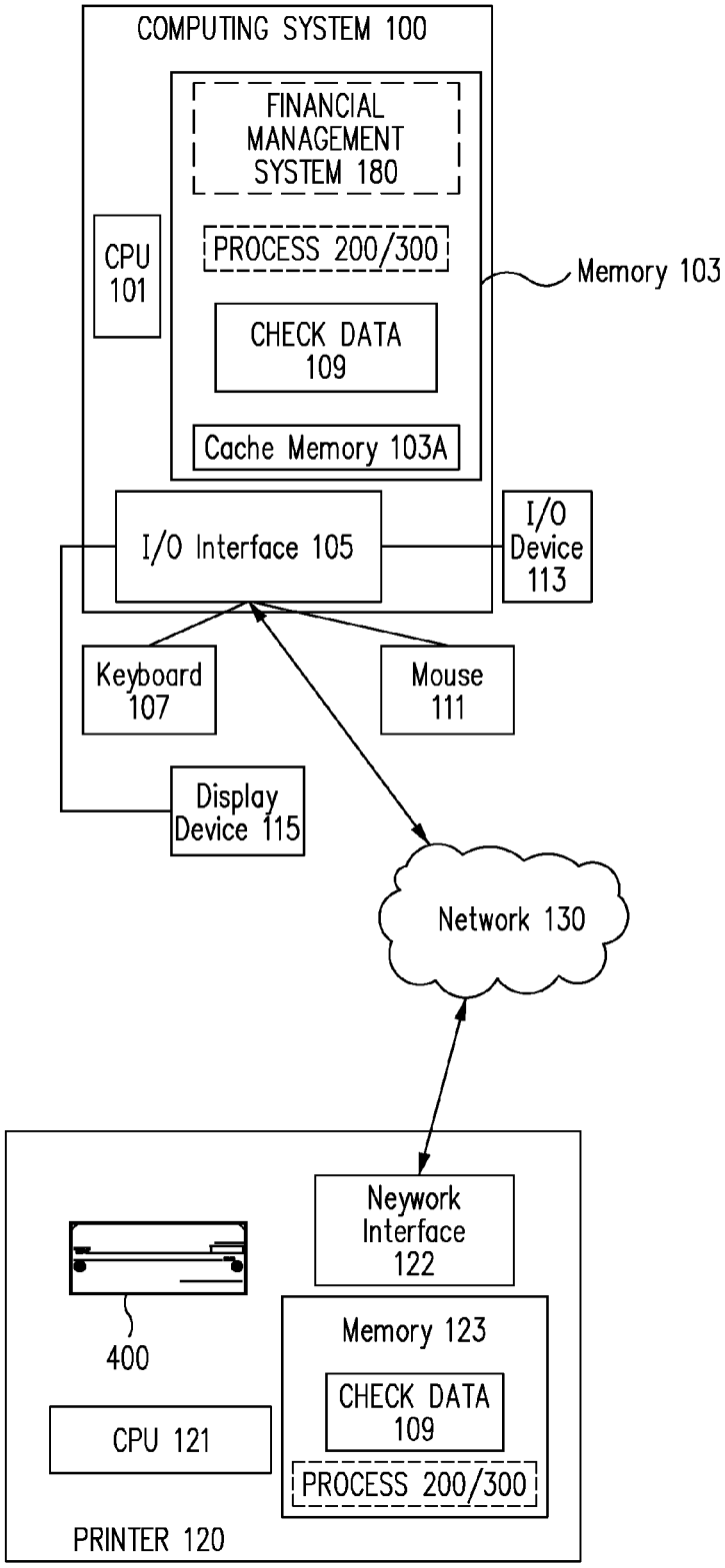
FIG. 1 is a block diagram of an exemplary hardware architecture for implementing one embodiment.

Common reference numerals are used throughout the FIGS. and the detailed description to indicate like elements. One skilled in the art will readily recognize that the above FIGS. are examples and that other architectures, modes of operation, orders of operation, and elements/functions can be provided and implemented without departing from the characteristics and features of the invention, as set forth in the claims.

DETAILED DESCRIPTION

Embodiments will now be discussed with reference to the accompanying FIGS., which depict one or more exemplary embodiments. Embodiments may be embodied in many different forms and should not be construed as limited to the embodiments set forth herein, shown in the FIGS., and/or described below. Rather, these exemplary embodiments are provided to allow a complete disclosure that conveys the principles of the invention, as set forth in the claims, to those of skill in the art.

In accordance with one embodiment, a system and method for providing tamper resistant checks includes a process for providing tamper resistant checks and the resultant tamper resistant checks.

In accordance with one embodiment, a tamper resistant check is created, and provided to a user, that in one embodiment, includes a first region on a first surface of the tamper resistant check.

In various embodiments, the first region on the first surface of the tamper resistant check is the background region of the check where no critical data is deemed likely to be added. Consequently, in various embodiments, the first region on the first surface of the tamper resistant check includes all portions of the check that do not generally receive toner-based characters and/or symbols, and/or that do not include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

In one embodiment, the tamper resistant check first surface also includes a second region, the second region on the first surface of the tamper resistant check being separate from the first region on the first surface of the tamper resistant check. In various embodiments, the second region on the first surface of the tamper resistant check corresponds to at least one critical field associated with the tamper resistant check including, but not limited to, one or more of the payee field, the amount field, and/or the signature field, and/or any portions of the tamper resistant check that typically receive toner-based characters and/or symbols, and/or that include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

In one embodiment, the first region on the first surface of the tamper resistant check is provided one or more anti-counterfeiting check features such as, but not limited to, printed, and/or colored, check surface designs, images, and/or patterns, which cover the first region on the first surface of the tamper resistant check. In one embodiment, the one or more anti-counterfeiting check features applied to the first region on the first surface of the tamper resistant check cover the entire first region on the first surface of the tamper resistant check to make it difficult to create a counterfeit copy of the tamper resistant check.

As noted above, in the prior art, in an attempt to prevent check counterfeiting, anti-counterfeiting check surface features such as a printed, and/or colored, check designs, images, and/or patterns were applied to the entire surface of the check, including the various check fields such as the amount and payee fields. As also noted above, while these anti-counterfeiting check features often did make it difficult to create counterfeit checks, the introduction of printed, and/or colored, check designs, images, and/or patterns covering the entire surface created an ideal background for perpetrating the toner removal/replacement form of check fraud. However, in contrast to the prior art, in accordance with one embodiment, the second region on the first surface of the tamper resistant check has no anti-counterfeiting check features applied.

In various embodiments, the second region on the first surface of the tamper resistant check is left blank, or bleached white, so that toner-based characters/symbols applied by a laser printer to the second region cannot be easily removed from the second region without leaving visible evidence. Since, as noted, in one embodiment, the second region(s) on the first surface of the tamper resistant check correspond(s) to one or more critical fields associated with the tamper resistant check, it follows that toner-based characters/symbols, once applied by a laser printer, cannot be removed from the critical fields and that no critical check data can be removed or replaced without leaving visible evidence of the change.

In various embodiments the second region on the first surface of the tamper resistant check has check features such as printed, and/or colored, check designs, images, but these check features are different from the anti-counterfeiting check features of the first region on the first surface of the tamper resistant check and also prevent toner-based characters applied by a laser printer to the second region from being removed from the second region without leaving visible evidence. Consequently, once again, toner-based characters/symbols cannot be removed from the critical fields and no critical check data can be removed or replaced without leaving visible evidence of the change.

In accordance with one embodiment, a system and method for providing tamper resistant checks includes a process for providing tamper resistant checks and the resultant tamper resistant checks.

In accordance with one embodiment, a tamper resistant check is created, and provided to a user, that in one embodiment, includes a first region on a first surface of the tamper resistant check.

In various embodiments, the first region on the first surface of the tamper resistant check is the background region of the check where no critical data is deemed likely to be added. Consequently, in various embodiments, the first region on the first surface of the tamper resistant check includes all portions of the check that do not generally receive toner-based characters and/or symbols, and/or that do not include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

In one embodiment, the tamper resistant check first surface also includes a second region, the second region on the first surface of the tamper resistant check being separate from the first region on the first surface of the tamper resistant check. In various embodiments, the second region on the first surface of the tamper resistant check corresponds to at least one critical field associated with the tamper resistant check including, but not limited to, one or more of the payee field, the amount field, and/or the signature field, and/or any portions of the tamper resistant check that typically receive toner-based characters and/or symbols, and/or that include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

In accordance with one embodiment, the first region on the first surface of the tamper resistant check is made of a first check substrate material. In various embodiments, the first check substrate material is standard check substrate material such as standard weight paper, chosen to provide a tamper resistant check first region that is as practical and durable as typical currently available check substrate materials.

In one embodiment, the first region on the first surface of the tamper resistant check is provided one or more anti-counterfeiting check features such as, but not limited to, printed, and/or colored, check surface designs, images, and/or patterns, which cover the first region on the first surface of the tamper resistant check. In one embodiment, the one or more anti-counterfeiting check features applied to the first region on the first surface of the tamper resistant check cover the entire first region on the first surface of the tamper resistant check to make it difficult to create a counterfeit copy of the tamper resistant check.

In one embodiment, the second region on the first surface of the tamper resistant check, is made of a second check substrate material that is distinct from the first check substrate material. In various embodiments, second check substrate material is relatively thin, and/or delicate, and is subject to damage in the event of tampering. In one embodiment, due to the delicate and damage prone second check substrate material, toner-based characters/symbols cannot be removed from the second region without leaving visible damage evidence. Since, as noted, in one embodiment, the second region(s) on the first surface of the tamper resistant check correspond(s) to one or more critical fields associated with the tamper resistant check, it follows that toner-based characters/symbols, once applied by a laser printer, cannot be removed from the critical fields and that no critical check data can be removed or replaced without leaving visible evidence of the change.

In various embodiments, the second region on the first surface of the tamper resistant check is also left blank, or bleached white, so that toner-based characters/symbols cannot be removed from the second region without leaving further visible evidence. This feature provides, in one embodiment, further protection from tampering as discussed above.

In various embodiments, the second region on the first surface of the tamper resistant check has check features such as printed, and/or colored, check designs, images, but these check features are different from the anti-counterfeiting check features of the first region on the first surface of the tamper resistant check and also prevent toner-based characters applied by a laser printer to the second region from being removed from the second region without leaving visible evidence. This feature also provides, in one embodiment, further protection from tampering as discussed above.

Hardware Architecture

FIG. 1 is a block diagram of an exemplary hardware architecture for implementing one embodiment of a system and method for providing tamper resistant checks, such as exemplary processes 200 and 300 discussed herein, that includes a computing system 100, e.g., a first computing system, and a printer 120, e.g., a laser printer, operatively coupled by a network 130.

As seen in FIG. 1, computing system 100 typically includes a central processing unit (CPU) 101, an input/output (I/O) interface 105, and a memory system 103, including cache memory 103A. In one embodiment, memory system 103 includes all, or part of, a financial management system 180. In one embodiment, financial management system 180 is any data management system as discussed herein, and/or as known in the art at the time of filing, and/or as developed after the time of filing, implemented, at least in part, on computing system 100, such as, but not limited to: a computing system implemented business financial management system; a computing system implemented business accounting system; a computing system implemented tax preparation system; a computing system implemented inventory management system; a computing system implemented asset management system or any other computing system implemented, or web-based, personal and/or business data management system.

In one embodiment, financial management system 180 is stored, in whole, or in part, in memory system 103, and is used by, or includes, as discussed below, a process for providing tamper resistant checks, such as processes 200 or 300.

In one embodiment, financial management system 180 is used to prepare, generate, or provide data for, tamper resistant checks, such as tamper resistant check 400, using check data 109 and printer 120.

Computing system 100 may further include standard user interface devices such as a keyboard 107, a mouse 111, and a display device 115, as well as, one or more standard input/output (I/O) devices 113, such as a compact disk (CD) or Digital Video Disc (DVD) drive, floppy disk drive, or other digital or waveform port, or other device capable of inputting data to, and outputting data from, computing system 100, whether available or known at the time of filing or as later developed. As discussed in more detail below, in one embodiment, a process for providing tamper resistant checks and/or a computing system implemented financial management system are entered, in whole, or in part, into computing system 100 via I/O device 113, such as from a CD, DVD, floppy disk, portable hard drive, memory stick, download site, or other medium and/or computer program product as defined herein.

In one embodiment, computing system 100 is a computing system accessible by a consumer and used and/or accessible by another computing system, a workstation, a two-way pager, a cellular telephone, a smart phone, a digital wireless telephone, a Personal Digital Assistant (PDA), a server computer, an Internet appliance, any other device, or any desired combination of these devices, that includes components that can execute all, or part, of a process for providing tamper resistant checks, and/or a computing system implemented financial management system, in accordance with at least one of the embodiments as described herein.

Also seen in FIG. 1 is printer 120 that typically includes a central processing unit (CPU) 121, a network interface 122, and a memory system 123. In one embodiment, memory system 123 includes all, or part of, a process for providing tamper resistant checks, such as processes 200 and/or 300.

In one embodiment, printer 120 receives check data 109 from computing system 100 and uses check data 109 to fill-in and print tamper resistant check 400.

In one embodiment, printer 120 is a laser printer. As noted above, the vast majority of checks used today, particularly those used by businesses, are laser printed checks whereby the various fields of the check, including the critical fields such as payee and/or amount fields, are filled in/populated with desired characters/symbols using laser printers, such as printer 120.

Laser printers have been widely adopted for decades and represent a significant technological advance over inkjet printers in terms of cost, practicality, speed, and efficiency. As a result, over 80% of all checks generated by printers are now generated by laser printers.

Unlike ink jet technology, laser printers do not use liquid ink that, in terms of countering fraud, advantageously soaks into the check substrate. Instead, laser printers utilize toner which is a form of powdered ink that is applied to the surface of the check and adhered to the check surface using heat to literally melt the toner onto the surface of the check, but not into the surface of the check. As a result, depending on the quality of the laser printer and the adhesion properties of the check, it can be relatively easy to remove the toner, i.e. the printed characters/symbols, from the surface of currently available checks generated with a laser printer.

In one embodiment, printer 120 is accessible by a consumer and/or business and is used and/or accessible by another computing system, a workstation, a two-way pager, a cellular telephone, a smart phone, a digital wireless telephone, a Personal Digital Assistant (PDA), a server computer, an Internet appliance, any other device, or any desired combination of these devices, that includes components that can execute all, or part, of a process for providing tamper resistant checks, and/or a computing system implemented data management system, in accordance with at least one of the embodiments as described herein.

In one embodiment, computing system 100 and printer 120, are coupled through network 130. Network 130 can be any network or network system that is of interest to a user such as, a peer-to-peer network, a hybrid peer-to-peer network, a Local Area Network (LAN), a Wide Area Network (WAN), a public network, such as the Internet, a private network, a combination of different network types, or other wireless, wired, and/or a wireless and wired combination network capable of allowing communication between two or more computing systems, whether available or known at the time of filing or as later developed.

In various embodiments, any one or more of computing system 100 and printer 120 are part of a cloud computing environment.

Those of skill in the art will readily recognize that the components shown in FIG. 1, such as computing system 100 and printer 120, and their respective components, are shown for illustrative purposes only and that architectures with more or fewer components can implement, and benefit from, the invention. Moreover, one or more components of computing system 100 and printer 120 may be located remotely from their respective system and accessed via network, as discussed herein. In addition, the particular type of, and configuration of, computing system 100 and printer 120 are not relevant.

Process

In accordance with one embodiment, a system and method for providing tamper resistant checks includes a process for providing tamper resistant checks whereby a tamper resistant check is created, and provided to a user, that in one embodiment, includes a first region on a first surface of the tamper resistant check that has one or more anti-counterfeiting check features such as, but not limited to, printed, and/or colored, check surface designs, images, and/or patterns, that cover at least part of the first region on the first surface of the tamper resistant check. In one embodiment, the tamper resistant check first surface also includes a second region, the second region on the first surface of the tamper resistant check being separate from the first region on the first surface of the tamper resistant check. In one embodiment, the second region on the first surface of the tamper resistant check has no anti-counterfeiting check features, e.g., is blank so that toner-based characters/symbols cannot be removed from these regions without leaving visible evidence. In another embodiment, the second region on the first surface of the tamper resistant check has check features different from the anti-counterfeiting check features of the first region on the first surface of the tamper resistant check that also prevent toner-based characters applied by a laser printer to the second region from being removed from the second region without leaving visible evidence. In one embodiment, the second region on the first surface of the tamper resistant check corresponds to at least one critical field associated with the tamper resistant check including, but not limited to, one or more of the payee field, the amount field, and/or the signature field.

Figure 2:
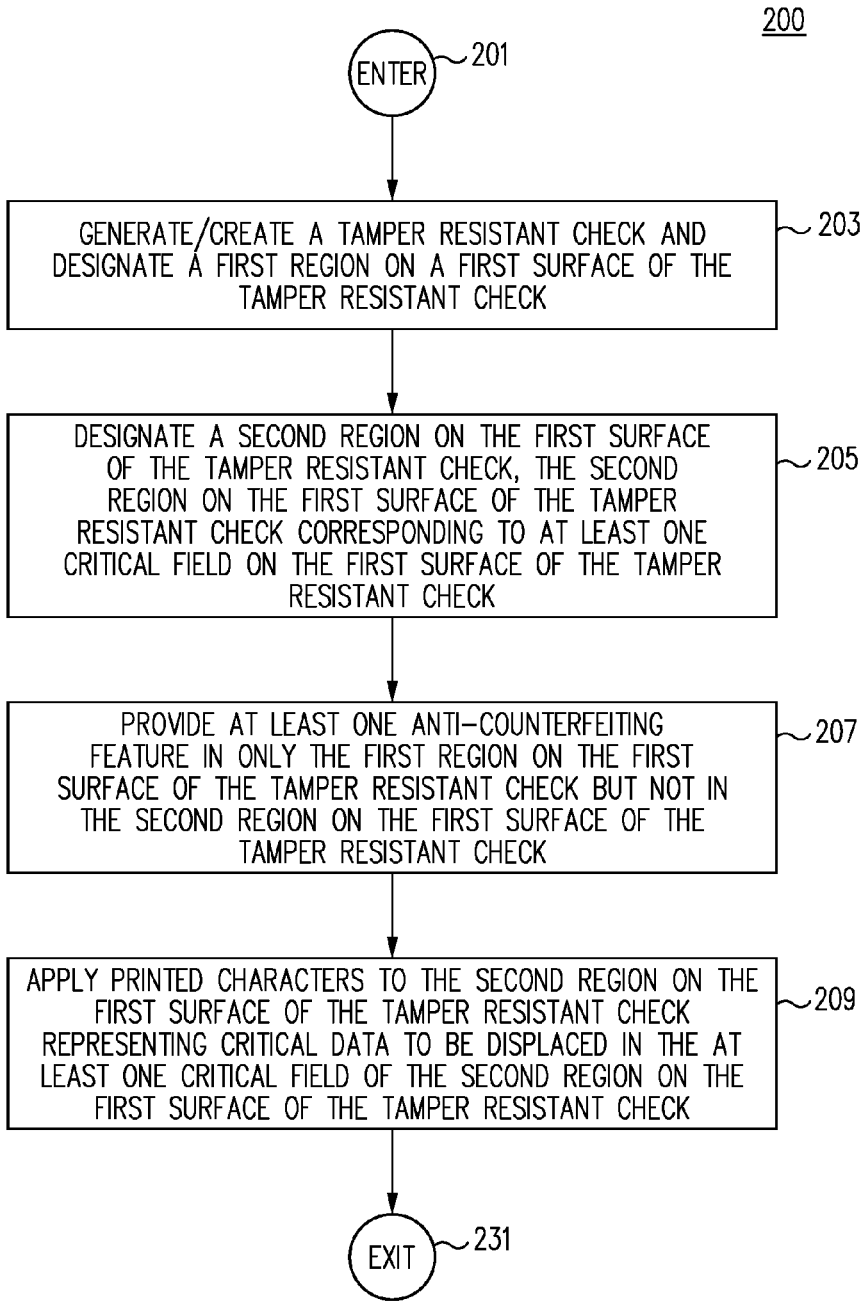
FIG. 2 is a flow chart depicting a process for providing tamper resistant checks in accordance with one embodiment.

FIG. 2 is a flow chart depicting a process for providing tamper resistant checks 200 in accordance with one embodiment. Process for providing tamper resistant checks 200 begins at ENTER OPERATION 201 and proceeds to GENERATE/CREATE A TAMPER RESISTANT CHECK AND DESIGNATE A FIRST REGION ON A FIRST SURFACE OF THE TAMPER RESISTANT CHECK OPERATION 203.

In one embodiment, at GENERATE/CREATE A TAMPER RESISTANT CHECK AND DESIGNATE A FIRST REGION ON A FIRST SURFACE OF THE TAMPER RESISTANT CHECK OPERATION 203 a tamper resistant check is created to include a first region on a first surface of the tamper resistant check.

In various embodiments, the first region on the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203 is the background region of the check where no critical data is deemed likely to be added. Consequently, in various embodiments, the first region on the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203 includes all portions of the check that do not generally receive toner-based characters and/or symbols, and/or that do not include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

Figure 4:
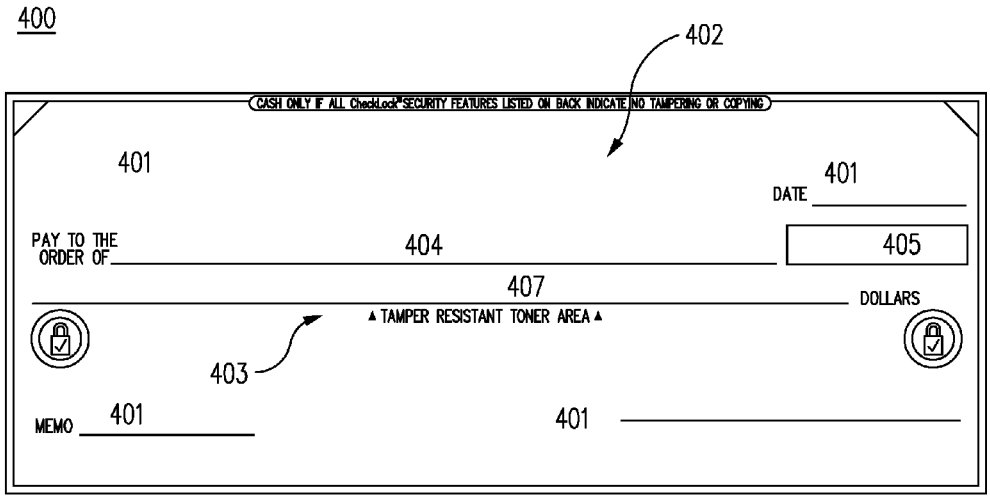
FIG. 4 is an illustrative image of a tamper resistant check generated in accordance with one embodiment.

FIG. 4 is an illustrative image of a tamper resistant check 400 generated in accordance with one embodiment of one of the processes for providing tamper resistant checks discussed herein. As seen in FIG. 4, in this particular illustrative example, tamper resistant check 400 includes first region 401 that includes all the surface area of first surface 402 of tamper resistant check 400 except second region 403 left blank as discussed below.

Returning to FIG. 2, in one embodiment, once a tamper resistant check is created to include a first region on a first surface of the tamper resistant check at GENERATE/CREATE A TAMPER RESISTANT CHECK AND DESIGNATE A FIRST REGION ON A FIRST SURFACE OF THE TAMPER RESISTANT CHECK OPERATION 203, process flow proceeds to DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205.

In one embodiment, at DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203 is also created to include a second region on the first surface of the tamper resistant check.

In one embodiment, the second region on the first surface of the tamper resistant check of DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 is a different region than the first region on the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203.

In various embodiments, the second region on the first surface of the tamper resistant check of DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 corresponds to at least one critical field associated with the tamper resistant check including, but not limited to, one or more of the payee field, the amount field, and/or the signature field, and/or any portions of the tamper resistant check that typically receive toner-based characters and/or symbols, and/or that include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

In various embodiments, more than one second region is designated on the first surface of the tamper resistant check at DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 that correspond to one or more critical fields associated with the tamper resistant check including, but not limited to, one or more of the payee field, the amount field, and/or the signature field, and/or any portions of the tamper resistant check that typically receive toner-based characters and/or symbols, and/or that include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

Returning to FIG. 4, as noted, FIG. 4 is an illustrative image of a tamper resistant check 400 generated in accordance with one embodiment of one of the processes for providing tamper resistant checks discussed herein. As seen in FIG. 4, in this particular illustrative example, tamper resistant check 400 includes second region 403 on first surface 402 of tamper resistant check 400. As also seen in FIG. 4, second region 403 includes: the critical payee field "PAY TO THE ORDER OF" 404 where the name of the payee will eventually be printed by a laser printer; the critical amount field "$" 405 where the numerical amount of the check will eventually be printed by a laser printer; and the critical amount field "DOLLARS" 407 where the spelled out/written amount of the check will eventually be printed by a laser printer.

Those of skill in the art will recognize that the particular critical fields of second region 403 on first surface 402 of tamper resistant check 400 in FIG. 4 are shown/selected for illustrative purposes only and that in other embodiments other critical fields can be defined and be encompassed in a second region on first surface of a tamper resistant check. Consequently, the specific illustrative example of a first region and a second region shown in FIG. 4 are not to be construed as limiting the embodiments as set forth in the claims below.

In one embodiment, once the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203 is also created to include a second region on the first surface of the tamper resistant check at DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205, process flow proceeds to PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207.

In one embodiment, at PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207 the first region on the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203 is provided one or more anti-counterfeiting check features while the second region on the first surface of the tamper resistant check of DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 is not provided any, or the same, anti-counterfeiting check features.

In one embodiment, at PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207 the first region on the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203 is provided one or more anti-counterfeiting check features such as, but not limited to, printed, and/or colored, check surface designs, images, and/or patterns, that cover at least part of the first region on the first surface of the tamper resistant check. In one embodiment, the one or more anti-counterfeiting check features applied to the first region on the first surface of the tamper resistant check cover the entire first region on the first surface of the tamper resistant check to make it difficult to create a counterfeit copy of the tamper resistant check.

As noted above, in the prior art, in an attempt to prevent check counterfeiting, anti-counterfeiting check surface features such as a printed, and/or colored, check designs, images, and/or patterns were applied to the entire surface of the check, including the various check fields such as the amount and payee fields. As also noted above, while these anti-counterfeiting check features often did make it difficult to create counterfeit checks, the introduction of printed, and/or colored, check designs, images, and/or patterns covering the entire surface created an ideal background for perpetrating the toner removal/replacement form of check fraud. However, as discussed below, in contrast to the prior art, in accordance with one embodiment, the second region on the first surface of the tamper resistant check of DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 has no anti-counterfeiting check features applied.

Returning to FIG. 4, as seen in FIG. 4, in this specific illustrative example of one embodiment first region 401 of first surface 402 of tamper resistant check 400 includes an anti-counterfeiting check feature in the form of a colored and printed design.

Returning to FIG. 2, in one embodiment, at PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207 the second region on the first surface of the tamper resistant check does not include anti-counterfeiting check features.

In one embodiment, at PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207 the second region on the first surface of the tamper resistant check is left blank, i.e., is devoid of any printed background design, color, or pattern, and/or is bleached white, or another color, so that once toner-based characters/symbols are applied in the second region by a laser printer, the toner-based characters/symbols applied by a laser printer to the second region cannot be removed from the second region without leaving visible evidence.

Since, as noted, in one embodiment, the second region(s) on the first surface of the tamper resistant check of DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 correspond(s) to one or more critical fields associated with the tamper resistant check, it follows that toner-based characters/symbols, once applied by a laser printer, cannot be removed from the critical fields and that no critical check data can be removed or replaced without leaving visible evidence of the change.

In one embodiment, at PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207 the second region on the first surface of the tamper resistant check does have check features such as printed, and/or colored, check designs, images, but these check features are different from the anti-counterfeiting check features of the first region on the first surface of the tamper resistant check and also prevent toner-based characters applied by a laser printer to the second region from being removed from the second region without leaving visible evidence.

Once again, in one embodiment, the second region(s) on the first surface of the tamper resistant check of DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 correspond(s) to one or more critical fields associated with the tamper resistant check, it follows that toner-based characters/symbols, once applied by a laser printer, cannot be removed from the critical fields and that no critical check data can be removed or replaced without leaving visible evidence of the change.

Returning to FIG. 4, as seen in FIG. 4, in this specific illustrative example of one embodiment, second region 401 of first surface 402 of tamper resistant check 400, including the critical payee field "PAY TO THE ORDER OF" 404 where the name of the payee will eventually be printed by a laser printer; the critical amount field "$" 405 where the numerical amount of the check will eventually be printed by a laser printer; and the critical amount field "DOLLARS" 407 where the written amount of the check will eventually be printed by a laser printer is blank, i.e., does not include the anti-counterfeiting check feature in the form of a colored and printed design of first region 401.

Returning to FIG. 2, in one embodiment, once the first region on the first surface of the tamper resistant check of GENERATE/CREATE A TAMPER RESISTANT CHECK AND DESIGNATE A FIRST REGION ON A FIRST SURFACE OF THE TAMPER RESISTANT CHECK OPERATION 203 is provided one or more anti-counterfeiting check features while the second region on the first surface of the tamper resistant check of DESIGNATE A SECOND REGION ON THE FIRST SURFACE OF THE TAMPER RESISTANT CHECK, THE SECOND REGION ON THE FIRST SURFACE OF THE TAMPER RESISTANT CHECK CORRESPONDING TO AT LEAST ONE CRITICAL FIELD ON THE FIRST SURFACE OF THE TAMPER RESISTANT CHECK OPERATION 205 is not provided anti-counterfeiting check features at PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207, process flow proceeds to APPLY PRINTED CHARACTERS TO THE SECOND REGION ON THE FIRST SURFACE OF THE TAMPER RESISTANT CHECK REPRESENTING CRITICAL DATA TO BE DISPLAYED IN THE AT LEAST ONE CRITICAL FIELD OF THE SECOND REGION ON THE FIRST SURFACE OF THE TAMPER RESISTANT CHECK OPERATION 209.

In one embodiment, at APPLY PRINTED CHARACTERS TO THE SECOND REGION ON THE FIRST SURFACE OF THE TAMPER RESISTANT CHECK REPRESENTING CRITICAL DATA TO BE DISPLAYED IN THE AT LEAST ONE CRITICAL FIELD OF THE SECOND REGION ON THE FIRST SURFACE OF THE TAMPER RESISTANT CHECK OPERATION 209 a laser printer applies toner-based characters/symbols to the critical fields of the second region of the first surface of the tamper resistant check of PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207 in accordance with the instructions from user of the tamper resistant check.

Since the second region of the tamper resistant check corresponds to critical fields such as, but not limited to, the payee field and/or the amount fields, and are left blank, and the toner-based characters cannot be removed from the second region without leaving visible evidence of their removal, the resulting tamper resistant check is largely invulnerable toner removal/replacement-based check fraud.

In one embodiment, once a laser printer applies toner-based characters/symbols to the critical fields of the second region of the first surface of the tamper resistant check of PROVIDE AT LEAST ONE ANTI-COUNTERFEITING FEATURE IN ONLY THE FIRST REGION ON THE FIRST SURFACE OF THE TAMPER RESISTANT CHECK BUT NOT IN THE SECOND REGION ON THE FIRST SURFACE OF THE TAMPER RESISTANT CHECK OPERATION 207 in accordance with the instructions from user of the tamper resistant check at APPLY PRINTED CHARACTERS TO THE SECOND REGION ON THE FIRST SURFACE OF THE TAMPER RESISTANT CHECK REPRESENTING CRITICAL DATA TO BE DISPLAYED IN THE AT LEAST ONE CRITICAL FIELD OF THE SECOND REGION ON THE FIRST SURFACE OF THE TAMPER RESISTANT CHECK OPERATION 209 process flow proceeds to EXIT OPERATION 231.

In one embodiment, at EXIT OPERATION 231, process for providing tamper resistant checks 200 is exited to await new data.

In the discussion above, certain aspects of one embodiment include process steps and/or operations and/or instructions described herein for illustrative purposes in a particular order and/or grouping. However, the particular order and/or grouping shown and discussed herein are illustrative only and not limiting. Those of skill in the art will recognize that other orders and/or grouping of the process steps and/or operations and/or instructions are possible and, in some embodiments, one or more of the process steps and/or operations and/or instructions discussed above can be combined and/or deleted. In addition, portions of one or more of the process steps and/or operations and/or instructions can be re-grouped as portions of one or more other of the process steps and/or operations and/or instructions discussed herein. Consequently, the particular order and/or grouping of the process steps and/or operations and/or instructions discussed herein do not limit the scope of the invention as claimed below.

Using process for providing tamper resistant checks 200, a tamper resistant check is provided wherein anti-counterfeiting check features such as, but not limited to, printed, and/or colored, check surface designs, images, and/or patterns, are provided on a first region of the first surface of the tamper resistant check so that the tamper resistant check is protected from attempts to counterfeit entire check. In addition, in one embodiment other regions of the tamper resistant check corresponding to critical fields such as, but not limited to, the payee field and/or the amount fields, are left blank, i.e., without any anti-counterfeiting check features, so that toner-based characters, once applied, cannot be removed from these regions without leaving visible evidence of their removal. Consequently, the resulting tamper resistant check is largely invulnerable to both counterfeit-based check fraud and toner removal/replacement-based check fraud.

In accordance with one embodiment, a system and method for providing tamper resistant checks includes a process for providing tamper resistant checks whereby a tamper resistant check is created, and provided to a user, that, in one embodiment, includes a first region on a first surface of the tamper resistant check that is comprised of a first check substrate material. In one embodiment, the tamper resistant check first surface also includes a second region on the first surface of the tamper resistant check, separate from the first region on the first surface of the tamper resistant check. In one embodiment, the second region on the first surface of the tamper resistant check is comprised of a second check substrate material that is distinct from the first check substrate material and is relatively delicate and subject to damage in the event of tampering. In one embodiment, the second region on the first surface of the tamper resistant check corresponds to at least one critical field associated with the check including, but not limited to, one or more of the payee field, the amount field, and/or the signature field.

Figure 3:
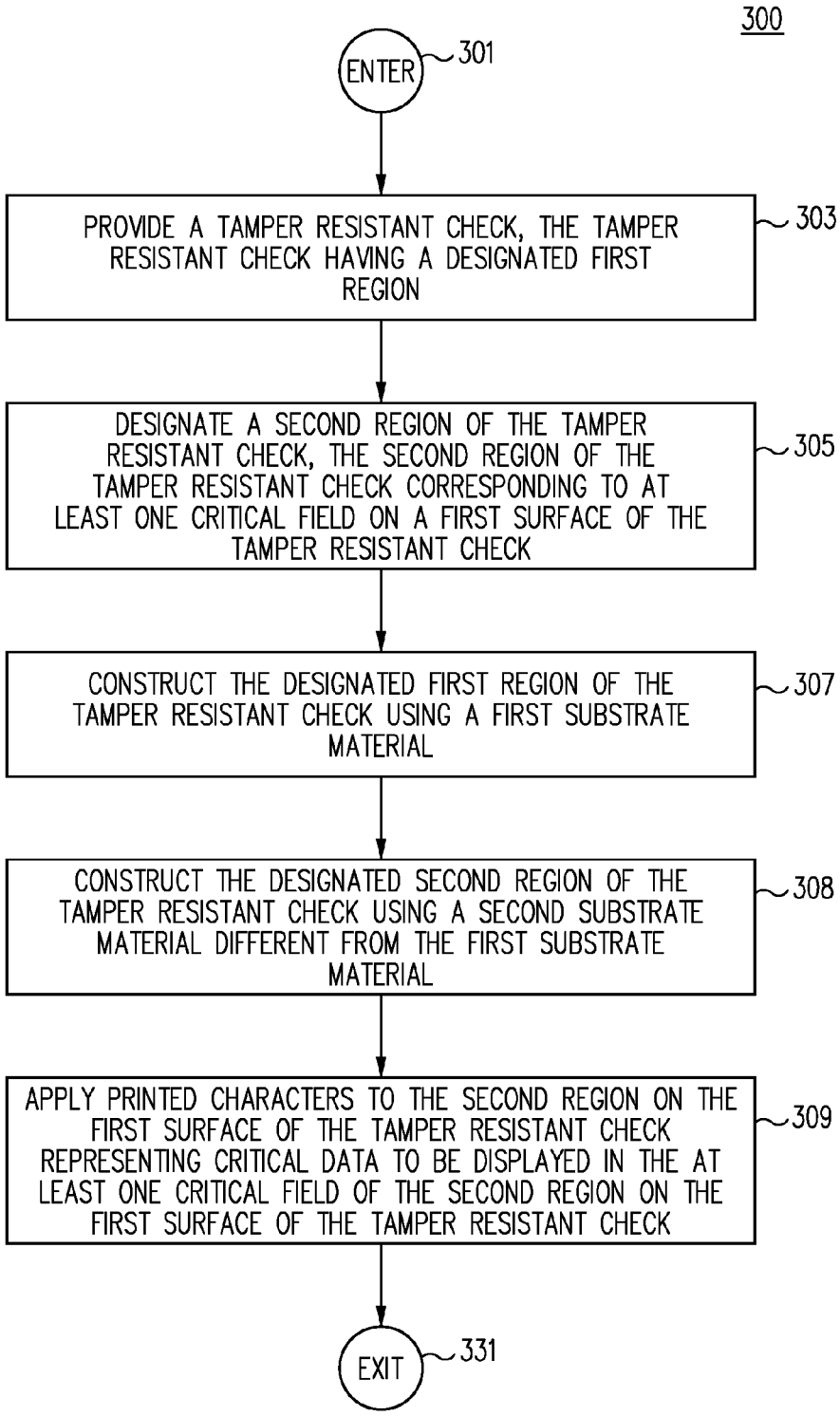
FIG. 3 is a flow chart depicting a process for providing tamper resistant checks in accordance with one embodiment.

FIG. 3 is a flow chart depicting a process for providing tamper resistant checks in accordance with one embodiment. Process for providing tamper resistant checks 300 begins at ENTER OPERATION 301 and proceeds to PROVIDE A TAMPER RESISTANT CHECK, THE TAMPER RESISTANT CHECK HAVING A DESIGNATED FIRST REGION OPERATION 303.

In one embodiment, at PROVIDE A TAMPER RESISTANT CHECK, THE TAMPER RESISTANT CHECK HAVING A DESIGNATED FIRST REGION OPERATION 303 a tamper resistant check is created to include a first region on a first surface of the tamper resistant check.

In various embodiments, the first region on the first surface of the tamper resistant check of PROVIDE A TAMPER RESISTANT CHECK, THE TAMPER RESISTANT CHECK HAVING A DESIGNATED FIRST REGION OPERATION 303 is the background region of the check where no critical data is deemed likely to be added. Consequently, in various embodiments, the first region on the first surface of the tamper resistant check of PROVIDE A TAMPER RESISTANT CHECK, THE TAMPER RESISTANT CHECK HAVING A DESIGNATED FIRST REGION OPERATION 303 includes all portions of the check that do not generally receive toner-based characters and/or symbols, and/or that do not include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

FIG. 4 is an illustrative image of a tamper resistant check 400 generated in accordance with one embodiment of one of the processes for providing tamper resistant checks discussed herein. As seen in FIG. 4, in this particular illustrative example, tamper resistant check 400 includes first region 401 that includes all the surface area of first surface 402 of tamper resistant check 400 except second region 403 as discussed below.

Returning to FIG. 3, in one embodiment, once a tamper resistant check is created to include a first region on a first surface of the tamper resistant check at PROVIDE A TAMPER RESISTANT CHECK, THE TAMPER RESISTANT CHECK HAVING A DESIGNATED FIRST REGION OPERATION 303, process flow proceeds to DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305.

In one embodiment, at DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305 the first surface of the tamper resistant check of PROVIDE A TAMPER RESISTANT CHECK, THE TAMPER RESISTANT CHECK HAVING A DESIGNATED FIRST REGION OPERATION 303 is also created to include a second region on the first surface of the tamper resistant check.

In one embodiment, the second region on the first surface of the tamper resistant check of DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305 is a different region than the first region on the first surface of the tamper resistant check of PROVIDE A TAMPER RESISTANT CHECK, THE TAMPER RESISTANT CHECK HAVING A DESIGNATED FIRST REGION OPERATION 303.

In various embodiments, the second region on the first surface of the tamper resistant check of DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305 corresponds to at least one critical field associated with the tamper resistant check including, but not limited to, one or more of the payee field, the amount field, and/or the signature field, and/or any portions of the tamper resistant check that typically receive toner-based characters and/or symbols, and/or that include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

In various embodiments, more than one second region is designated on the first surface of the tamper resistant check at DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305 that correspond to one or more critical fields associated with the tamper resistant check including, but not limited to, one or more of the payee field, the amount field, and/or the signature field, and/or any portions of the tamper resistant check that typically receive toner-based characters and/or symbols, and/or that include critical fields, or critical data, that identify the payee associated with the check, and/or the written amount of the check, and/or the numerical amount of the check, or any other data associated with the check deemed to be sensitive and/or critical to ensuring the check is cashed by the legitimate payee and/or for the intended amount.

Returning to FIG. 4, as noted, FIG. 4 is an illustrative image of a tamper resistant check 400 generated in accordance with one embodiment of one of the processes for providing tamper resistant checks discussed herein. As seen in FIG. 4, in this particular illustrative example, tamper resistant check 400 includes second region 403 on first surface 402 of tamper resistant check 400. As also seen in FIG. 4, second region 403 includes: the critical payee field "PAY TO THE ORDER OF" 404 where the name of the payee will eventually be printed by a laser printer; the critical amount field "$" 405 where the numerical amount of the check will eventually be printed by a laser printer; and the critical amount field "DOLLARS" 407 where the written amount of the check will eventually be printed by a laser printer.

In one embodiment, once the first surface of the tamper resistant check of PROVIDE A TAMPER RESISTANT CHECK, THE TAMPER RESISTANT CHECK HAVING A DESIGNATED FIRST REGION OPERATION 303 is also created to include a second region on the first surface of the tamper resistant check at DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305, process flow proceeds to CONSTRUCT THE DESIGNATED FIRST REGION OF THE TAMPER RESISTANT CHECK USING A FIRST SUBSTRATE MATERIAL OPERATION 307.

In one embodiment, at CONSTRUCT THE DESIGNATED FIRST REGION OF THE TAMPER RESISTANT CHECK USING A FIRST SUBSTRATE MATERIAL OPERATION 307 the first region on the first surface of the tamper resistant check of PROVIDE A TAMPER RESISTANT CHECK, THE TAMPER RESISTANT CHECK HAVING A DESIGNATED FIRST REGION OPERATION 303 is made of a first check substrate material.

In various embodiments, the first check substrate material of CONSTRUCT THE DESIGNATED FIRST REGION OF THE TAMPER RESISTANT CHECK USING A FIRST SUBSTRATE MATERIAL OPERATION 307 is standard check substrate material such as standard weight paper, chosen to provide a tamper resistant check first region that is as practical and durable as typical currently available check substrate materials.

In one embodiment, the first region on the first surface of the tamper resistant check of CONSTRUCT THE DESIGNATED FIRST REGION OF THE TAMPER RESISTANT CHECK USING A FIRST SUBSTRATE MATERIAL OPERATION 307 is also provided one or more anti-counterfeiting check features such as, but not limited to, printed, and/or colored, check surface designs, images, and/or patterns, that cover at least part of the first region on the first surface of the tamper resistant check. In one embodiment, the one or more anti-counterfeiting check features applied to the first region on the first surface of the tamper resistant check cover the entire first region on the first surface of the tamper resistant check to make it difficult to create a counterfeit copy of the tamper resistant check.

In one embodiment, once the first region on the first surface of the tamper resistant check of PROVIDE A TAMPER RESISTANT CHECK, THE TAMPER RESISTANT CHECK HAVING A DESIGNATED FIRST REGION OPERATION 303 is made of a first check substrate material at CONSTRUCT THE DESIGNATED FIRST REGION OF THE TAMPER RESISTANT CHECK USING A FIRST SUBSTRATE MATERIAL OPERATION 307, process flow proceeds to CONSTRUCT THE DESIGNATED SECOND REGION OF THE TAMPER RESISTANT CHECK USING A SECOND SUBSTRATE MATERIAL DIFFERENT FROM THE FIRST SUBSTRATE MATERIAL OPERATION 308.

In one embodiment, at CONSTRUCT THE DESIGNATED SECOND REGION OF THE TAMPER RESISTANT CHECK USING A SECOND SUBSTRATE MATERIAL DIFFERENT FROM THE FIRST SUBSTRATE MATERIAL OPERATION 308 the second region on the first surface of the tamper resistant check, is made of a second check substrate material that is distinct from the first check substrate material.

In various embodiments, at CONSTRUCT THE DESIGNATED SECOND REGION OF THE TAMPER RESISTANT CHECK USING A SECOND SUBSTRATE MATERIAL DIFFERENT FROM THE FIRST SUBSTRATE MATERIAL OPERATION 308 second check substrate material is relatively thin, and/or delicate, and is subject to damage such as scratching and/or tearing in the event of tampering.

In one embodiment, due to the delicate and damage prone second check substrate material of CONSTRUCT THE DESIGNATED SECOND REGION OF THE TAMPER RESISTANT CHECK USING A SECOND SUBSTRATE MATERIAL DIFFERENT FROM THE FIRST SUBSTRATE MATERIAL OPERATION 308, toner-based characters/symbols cannot be removed from the second region without leaving visible damage evidence.

Since, as noted, in one embodiment, the second region(s) on the first surface of the tamper resistant check of DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305 correspond(s) to one or more critical fields associated with the tamper resistant check, it follows that toner-based characters/symbols, once applied by a laser printer, cannot be removed from the critical fields and that no critical check data can be removed or replaced without leaving visible evidence of the change.

In various embodiments, the second region on the first surface of the tamper resistant check is also left blank, or bleached white, or another color, DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305 so that once toner-based characters/symbols are applied by a laser printer they cannot be removed from the second region without leaving further visible evidence. This feature provides, in one embodiment, further protection from tampering as discussed above with respect to FIG. 2.

In various embodiments the second region on the first surface of the tamper resistant check of DESIGNATE A SECOND REGION OF THE TAMPER RESISTANT CHECK, THE SECOND REGION OF THE TAMPER RESISTANT CHECK CORRESPONDING TO AT LEAST ONE CRITICAL FIELD ON A FIRST SURFACE OF THE TAMPER RESISTANT CHECK OPERATION 305 has check features such as printed, and/or colored, check designs, images, but these check features are different from the anti-counterfeiting check features of the first region on the first surface of the tamper resistant check and also prevent toner-based characters applied by a laser printer to the second region from being removed from the second region without leaving visible evidence. This feature also provides, in one embodiment, further protection from tampering as discussed above.

In one embodiment, once the second region on the first surface of the tamper resistant check is made of a second check substrate material that is distinct from the first check substrate material at CONSTRUCT THE DESIGNATED SECOND REGION OF THE TAMPER RESISTANT CHECK USING A SECOND SUBSTRATE MATERIAL DIFFERENT FROM THE FIRST SUBSTRATE MATERIAL OPERATION 308, process flow proceeds to APPLY PRINTED CHARACTERS TO THE SECOND REGION ON THE FIRST SURFACE OF THE TAMPER RESISTANT CHECK REPRESENTING CRITICAL DATA TO BE DISPLAYED IN THE AT LEAST ONE CRITICAL FIELD OF THE SECOND REGION ON THE FIRST SURFACE OF THE TAMPER RESISTANT CHECK OPERATION 309.

In one embodiment, at APPLY PRINTED CHARACTERS TO THE SECOND REGION ON THE FIRST SURFACE OF THE TAMPER RESISTANT CHECK REPRESENTING CRITICAL DATA TO BE DISPLAYED IN THE AT LEAST ONE CRITICAL FIELD OF THE SECOND REGION ON THE FIRST SURFACE OF THE TAMPER RESISTANT CHECK OPERATION 309 a laser printer applies toner-based characters/symbols to the critical fields of the second region of the first surface of the tamper resistant check of CONSTRUCT THE DESIGNATED SECOND REGION OF THE TAMPER RESISTANT CHECK USING A SECOND SUBSTRATE MATERIAL DIFFERENT FROM THE FIRST SUBSTRATE MATERIAL OPERATION 308 in accordance with the instructions from user of the tamper resistant check.

Since the second region of the tamper resistant check corresponds to critical fields such as, but not limited to, the payee field and/or the amount fields, are left blank, and the toner-based characters cannot be removed from the second region without leaving visible evidence of their removal, the resulting tamper resistant check is largely invulnerable toner removal/replacement-based check fraud.

In one embodiment, once a laser printer applies toner-based characters/symbols to the critical fields of the second region of the first surface of the tamper resistant check of CONSTRUCT THE DESIGNATED SECOND REGION OF THE TAMPER RESISTANT CHECK USING A SECOND SUBSTRATE MATERIAL DIFFERENT FROM THE FIRST SUBSTRATE MATERIAL OPERATION 308 in accordance with the instructions from user of the tamper resistant check at APPLY PRINTED CHARACTERS TO THE SECOND REGION ON THE FIRST SURFACE OF THE TAMPER RESISTANT CHECK REPRESENTING CRITICAL DATA TO BE DISPLAYED IN THE AT LEAST ONE CRITICAL FIELD OF THE SECOND REGION ON THE FIRST SURFACE OF THE TAMPER RESISTANT CHECK OPERATION 309 process flow proceeds to EXIT OPERATION 331.

In one embodiment, at EXIT OPERATION 331, process for providing tamper resistant checks 300 is exited to await new data.

In the discussion above, certain aspects of one embodiment include process steps and/or operations and/or instructions described herein for illustrative purposes in a particular order and/or grouping. However, the particular order and/or grouping shown and discussed herein are illustrative only and not limiting. Those of skill in the art will recognize that other orders and/or grouping of the process steps and/or operations and/or instructions are possible and, in some embodiments, one or more of the process steps and/or operations and/or instructions discussed above can be combined and/or deleted. In addition, portions of one or more of the process steps and/or operations and/or instructions can be re-grouped as portions of one or more other of the process steps and/or operations and/or instructions discussed herein. Consequently, the particular order and/or grouping of the process steps and/or operations and/or instructions discussed herein do not limit the scope of the invention as claimed below.

Using process for providing tamper resistant checks 300, a tamper resistant check is provided wherein a first region or portion of the tamper resistant check is made of a first substrate material, such as relatively durable and/or thick paper, while a second region of the tamper resistant check corresponding to critical fields such as, but not limited to, the payee field and/or the amount field, are made of a second substrate material that is relatively thin, and/or fragile, so that any attempts to remove and/or replace toner from the second region will result in the visible tearing, and/or damaging, of the second substrate material. Consequently, the resulting tamper resistant check is largely invulnerable to toner removal/replacement-based check fraud while still providing a relatively durable and practical tamper resistant check.

The present invention has been described in particular detail with respect to specific possible embodiments. Those of skill in the art will appreciate that the invention may be practiced in other embodiments. For example, the nomenclature used for components, capitalization of component designations and terms, the attributes, data structures, or any other programming or structural aspect is not significant, mandatory, or limiting, and the mechanisms that implement the invention or its features can have various different names, formats, and/or protocols. Further, the system and/or functionality of the invention may be implemented via various combinations of software and hardware, as described, or entirely in hardware elements. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

Some portions of the above description present the features of the present invention in terms of algorithms and symbolic representations of operations, or algorithm-like representations, of operations on information/data. These algorithmic and/or algorithm-like descriptions and representations are the means used by those of skill in the art to most effectively and efficiently convey the substance of their work to others of skill in the art. These operations, while described functionally or logically, are understood to be implemented by computer programs and/or computing systems. Furthermore, it has also proven convenient at times to refer to these arrangements of operations as steps or modules or by functional names, without loss of generality.

Unless specifically stated otherwise, as would be apparent from the above discussion, it is appreciated that throughout the above description, discussions utilizing terms such as "activating", "accessing", "applying", "analyzing", "calculating", "capturing", "categorizing", "classifying", "comparing", "defining", "detecting", "determining", "designate", "distributing", "encrypting", "extracting", "filtering", "forwarding", "generating", "identifying", "implementing", "monitoring", "obtaining", "processing", "providing", "receiving", "requesting", "saving", "sending", "storing", "transferring", "transforming", "using", etc., refer to the action and process of a computing system or similar electronic device that manipulates and operates on data represented as physical (electronic) quantities within the computing system memories, resisters, caches or other information storage, transmission or display devices.

Certain aspects of the present invention include process steps or operations and instructions described herein in an algorithmic and/or algorithmic-like form. It should be noted that the process steps and/or operations and instructions of the present invention can be embodied in software, firmware, and/or hardware, and when embodied in software, can be downloaded to reside on and be operated from different platforms used by real time network operating systems.

The present invention also relates to an apparatus or system for performing the operations described herein. This apparatus or system may be specifically constructed for the required purposes, or the apparatus or system can comprise a general purpose system selectively activated or configured/reconfigured by a computer program stored on a computer program product as defined herein that can be accessed by a computing system or other device.

Those of skill in the art will readily recognize that the algorithms and operations presented herein are not inherently related to any particular computing system, computer architecture, computer or industry standard, or any other specific apparatus. Various general purpose systems may also be used with programs in accordance with the teaching herein, or it may prove more convenient/efficient to construct more specialized apparatuses to perform the required operations described herein. The required structure for a variety of these systems will be apparent to those of skill in the art, along with equivalent variations. In addition, the present invention is not described with reference to any particular programming language and it is appreciated that a variety of programming languages may be used to implement the teachings of the present invention as described herein, and any references to a specific language or languages are provided for illustrative purposes only and for enablement of the contemplated best mode of the invention at the time of filing.

The present invention is well suited to a wide variety of computer network systems operating over numerous topologies. Within this field, the configuration and management of large networks comprise storage devices and computers that are communicatively coupled to similar and/or dissimilar computers and storage devices over a private network, a LAN, a WAN, a private network, or a public network, such as the Internet.

It should also be noted that the language used in the specification has been principally selected for readability, clarity and instructional purposes, and may not have been selected to delineate or circumscribe the inventive subject matter.

Accordingly, the disclosure of the present invention is intended to be illustrative, but not limiting, of the scope of the invention, which is set forth in the claims below.

In addition, the operations shown in the FIGS. for method and apparatus and/or process or application for providing scroll bar enabled bookmarks in electronic document displays, discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A tamper resistant check comprising:

a first region on a first surface of the tamper resistant check, the first region on the first surface of the tamper resistant check having one or more anti-counterfeiting check features; and a second region on the first surface of the tamper resistant check, the second region on the first surface of the tamper resistant check being distinct from the first region on the first surface of the tamper resistant check, the second region on the first surface of the tamper resistant check having no anti-counterfeiting features, the second region on the first surface of the tamper resistant check corresponding to at least one critical field associated with the tamper resistant check.

2. The tamper resistant check of claim 1 wherein;

at least one of the one or more anti-counterfeiting check features is selected from the group of anti-counterfeiting check features consisting of:

at least one printed design that covers at least part of the first region on the first surface of the tamper resistant check;

at least one printed image that covers at least part of the first region on the first surface of the tamper resistant check;

at least one printed pattern that covers at least part of the first region on the first surface of the tamper resistant check; and at least two colors that cover at least part of the first region on the first surface of the tamper resistant check.

3. The tamper resistant check of claim 1 wherein;

at least one critical field associated with the tamper resistant check corresponding to the second region on the first surface of the tamper resistant check includes the spelled out amount field.

4. The tamper resistant check of claim 1 wherein;

at least one critical field associated with the tamper resistant check corresponding to the second region on the first surface of the tamper resistant check includes the numerical amount field.

5. The tamper resistant check of claim 1 wherein;

at least one critical field associated with the tamper resistant check corresponding to the second region on the first surface of the tamper resistant check includes the payee field.

6. A tamper resistant check comprising:

a first region on a first surface of the tamper resistant check, the first region on the first surface of the tamper resistant check being constructed of a first check substrate material; and a second region on the first surface of the tamper resistant check, the second region on the first surface of the tamper resistant check being distinct from the first region on the first surface of the tamper resistant check, the second region on the first surface of the tamper resistant check being constructed of a second check substrate material, the second region on the first surface of the tamper resistant check corresponding to at least one critical field associated with the tamper resistant check.

7. The tamper resistant check of claim 6 wherein;

at least one critical field associated with the tamper resistant check corresponding to the second region on the first surface of the tamper resistant check includes the spelled out amount field.

8. The tamper resistant check of claim 6 wherein;

at least one critical field associated with the tamper resistant check corresponding to the second region on the first surface of the tamper resistant check includes the numerical amount field.

9. The tamper resistant check of claim 6 wherein;

at least one critical field associated with the tamper resistant check corresponding to the second region on the first surface of the tamper resistant check includes the payee field.

10. A system for providing tamper resistant checks comprising;

a laser printer;

a tamper resistant check, the tamper resistant check including a first region on a first surface of the tamper resistant check, the first region on the first surface of the tamper resistant check having one or more anti-counterfeiting check features, the tamper resistant check including a second region on the first surface of the tamper resistant check, the second region on the first surface of the tamper resistant check being distinct from the first region on the first surface of the tamper resistant check, the second region on the first surface of the tamper resistant check having no anti-counterfeiting features, the second region on the first surface of the tamper resistant check corresponding to at least one critical field associated with the tamper resistant check; and characters and/or symbols printed in the second region on the first surface of the tamper resistant check, the characters and/or symbols being printed by the laser printer.

11. The system for providing tamper resistant checks of claim 10 wherein;

at least one of the one or more anti-counterfeiting check features is selected from the group of anti-counterfeiting check features consisting of:

at least one printed design that covers at least part of the first region on the first surface of the tamper resistant check;

at least one printed image that covers at least part of the first region on the first surface of the tamper resistant check;

at least one printed pattern that covers at least part of the first region on the first surface of the tamper resistant check; and at least two colors that cover at least part of the first region on the first surface of the tamper resistant check.

12. The system for providing tamper resistant checks of claim 10 wherein;

at least one critical field associated with the tamper resistant check corresponding to the second region on the first surface of the tamper resistant check includes the spelled out amount field.

13. The system for providing tamper resistant checks of claim 10 wherein;

at least one critical field associated with the tamper resistant check corresponding to the second region on the first surface of the tamper resistant check includes the numerical amount field.

14. The system for providing tamper resistant checks of claim 10 wherein;

at least one critical field associated with the tamper resistant check corresponding to the second region on the first surface of the tamper resistant check includes the payee field.

15. A system for providing tamper resistant checks comprising;

a laser printer;

a tamper resistant check, the tamper resistant check including a first region on a first surface of the tamper resistant check, the first region on the first surface of the tamper resistant check being constructed of a first check substrate material, the tamper resistant check including a second region on the first surface of the tamper resistant check, the second region on the first surface of the tamper resistant check being distinct from the first region on the first surface of the tamper resistant check, the second region on the first surface of the tamper resistant check being constructed of a second check substrate material, the second region on the first surface of the tamper resistant check corresponding to at least one critical field associated with the tamper resistant check; and characters and/or symbols printed in the second region on the first surface of the tamper resistant check, the characters and/or symbols being printed by the laser printer.

16. The system for providing tamper resistant checks of claim 15 wherein;

at least one critical field associated with the tamper resistant check corresponding to the second region on the first surface of the tamper resistant check includes the spelled out amount field.

17. The system for providing tamper resistant checks of claim 15 wherein;

at least one critical field associated with the tamper resistant check corresponding to the second region on the first surface of the tamper resistant check includes the numerical amount field.

18. The system for providing tamper resistant checks of claim 15 wherein;

at least one critical field associated with the tamper resistant check corresponding to the second region on the first surface of the tamper resistant check includes the payee field.

19. A method for providing tamper resistant checks comprising:

providing a tamper resistant check, the tamper resistant check including a first region on a first surface of the tamper resistant check, the first region on the first surface of the tamper resistant check having one or more anti-counterfeiting check features, providing a second region on the first surface of the tamper resistant check, the second region on the first surface of the tamper resistant check being distinct from the first region on the first surface of the tamper resistant check, the second region on the first surface of the tamper resistant check having no anti-counterfeiting features so that toner-based characters or symbols cannot be removed from the second region on the first surface of the tamper resistant check without leaving visible evidence of the removal, the second region on the first surface of the tamper resistant check corresponding to at least one critical field associated with the tamper resistant check; and printing characters and/or symbols in the second region on the first surface of the tamper resistant check.

20. The method for providing tamper resistant checks of claim 19 wherein;

at least one of the one or more anti-counterfeiting check features is selected from the group of anti-counterfeiting check features consisting of:

at least one printed design that covers at least part of the first region on the first surface of the tamper resistant check;

at least one printed image that covers at least part of the first region on the first surface of the tamper resistant check;

at least one printed pattern that covers at least part of the first region on the first surface of the tamper resistant check; and at least two colors that cover at least part of the first region on the first surface of the tamper resistant check.

21. The method for providing tamper resistant checks of claim 19 wherein;

at least one critical field associated with the tamper resistant check corresponding to the second region on the first surface of the tamper resistant check includes the spelled out amount field.

22. The method for providing tamper resistant checks of claim 19 wherein;

at least one critical field associated with the tamper resistant check corresponding to the second region on the first surface of the tamper resistant check includes the numerical amount field.

23. The method for providing tamper resistant checks of claim 19 wherein;

at least one critical field associated with the tamper resistant check corresponding to the second region on the first surface of the tamper resistant check includes the payee field.

24. A method for providing tamper resistant checks comprising;

providing a tamper resistant check, the tamper resistant check including a first region on a first surface of the tamper resistant check, the first region on the first surface of the tamper resistant check being constructed of a first check substrate material, providing a second region on the first surface of the tamper resistant check, the second region on the first surface of the tamper resistant check being distinct from the first region on the first surface of the tamper resistant check, the second region on the first surface of the tamper resistant check being constructed of a second check substrate material such so that toner-based characters or symbols cannot be removed from the second region on the first surface of the tamper resistant check without damaging the second check substrate material, the second region on the first surface of the tamper resistant check corresponding to at least one critical field associated with the tamper resistant check; and printing characters and/or symbols in the second region on the first surface of the tamper resistant check.

25. The method for providing tamper resistant checks of claim 24 wherein;

at least one critical field associated with the tamper resistant check corresponding to the second region on the first surface of the tamper resistant check includes the spelled out amount field.

26. The method for providing tamper resistant checks of claim 24 wherein;

at least one critical field associated with the tamper resistant check corresponding to the second region on the first surface of the tamper resistant check includes the numerical amount field.

27. The method for providing tamper resistant checks of claim 24 wherein;

at least one critical field associated with the tamper resistant check corresponding to the second region on the first surface of the tamper resistant check includes the payee field.

* * * * *